United States Patent [19]

Huther

[11] Patent Number: 4,475,494

[45] Date of Patent: Oct. 9, 1984

[54] VALVE FOR AN INTERNAL COMBUSTION ENGINE

[75] Inventor: Werner Huther, Karlsfeld, Fed. Rep. of Germany

[73] Assignee: MTU Motoren-und Turbinen-Union Munchen GmbH, Munich, Fed. Rep. of Germany

[21] Appl. No.: 379,607

[22] Filed: May 19, 1982

[30] Foreign Application Priority Data

Jun. 6, 1981 [DE] Fed. Rep. of Germany ..... 3122603

[51] Int. Cl.[3] ..... F01L 3/20; F01L 3/22

[52] U.S. Cl. ..... 123/188 A; 123/188 AA; 123/188 S

[58] Field of Search ..... 123/188 A, 188 AA, 188 S, 123/188 B; 251/333; 137/468

[56] References Cited

U.S. PATENT DOCUMENTS 2,090,800 7/1936 MacDonald ..... 123/188 S 4,359,022 11/1982 Nakamura et al. ..... 123/188 A

*Primary Examiner*—Craig R. Feinberg

*Assistant Examiner*—David A. Okonsky

*Attorney, Agent, or Firm*—Alan H. Levine

[57] ABSTRACT

A valve for an internal combustion engine having mutually cooperating sealing surfaces, both of which are cylindrical. At least the movable valve member, carrying one of the sealing surfaces, is made of ceramic material. The movable valve member may be disk-shaped or have a bulbous or drop shape. The valve member may have a hollow cylindrical body reciprocable through a hole in a wall, a circumferentially arranged port in the body being selectively closed by moving the body into the hole.

6 Claims, 4 Drawing Figures

VALVE FOR AN INTERNAL COMBUSTION ENGINE

This invention relates to valves, and more particularly to an intake or exhaust valve on an internal-combustion engine or on the combustion cylinder thereof.

Exhaust and intake valves of internal-combustion engines, and the associated valve train, are generally known, especially in the following arrangement.

The valve is arranged in a cylinder head or cover. A reciprocating valve member in the shape of a valve head is formed, together with a valve stem, as a single-piece unit made of steel. The unit is a body of revolution and is arranged for reciprocating movement in the direction of its longitudinal centerline. The two cooperating, mutually parallel sealing surfaces of the valve are truncated cone surfaces. While in its closed position, the valve head is urged, under the force of a helical compression spring, in a direction to bring its sealing surface against the stationary sealing surface.

The heat transmitted to the valve head is dissipated, while the valve is closed, to the water or air cooled cylinder head through the truncated conical valve seat. The volume of heat dissipated is rather modest, so that, in particular, the valve head may suffer from excess heat, and so thermal loads on such valves must be kept rather low. Another requirement is that play be allowed and maintained between the rocker arm, or a similar component of the valve train, and the valve stem. Such play helps the valve head, e.g., in the presence of dissimilar thermal expansions of the valve train, on the one hand, and the cylinder head, on the other, to be urged against the stationary sealing surface, for a snug and tight fit to achieve whatever moderate heat dissipation is possible in the closed position of the valve. This play, however, causes very great forces of acceleration when the rocker arm, or similar component, hits the valve stem at the time the valve opens, and again when the valve head hits the valve seat at the time the valve closes. This imposes considerable mechanical loads on the valve and produces considerable noise.

Also encountered are flow problems, with turbulances occurring ahead and behind the valve head. The conical pattern of the fluid (which is air in the Diesel engine and a fuel/gas mixture in the Otto engine) during its flow from the intake valve into the combustion space is not invariably a benefit.

In a broad aspect, the present invention provides a valve which reduces or eliminates the play mentioned above, is more tolerant of heat, and in most cases at least alleviates the flow problems described.

It is a particular object of the present invention to provide a valve wherein the cooperating sealing surfaces are cylindrical, and at least the reciprocable valve member is made of a ceramic material.

With the aid of these cylindrical surfaces, which concomitantly serve as guide surfaces, and because the cylinder axis extends in the direction of valve movement, the play between rocker arm and valve stem can safely be reduced or eliminated, because the reciprocating valve member need no longer abut against a valve seat. Also reduced or eliminated are extreme accelerations and accordingly high impact forces, which substantially facilitates the use of a ceramic material.

Owing to the considerable thermal stability of the ceramic material, very effective heat dissipation from the movable ceramic valve member is no longer required. This enables the cooperating sealing surfaces to be made cylindrical surfaces, the cylinder axis of which extends in the direction of valve movement. The movable ceramic valve member can safely pick up a great amount of heat. The heat tolerance of the valve or valve member is improved over that of the conventional valve member.

The use of a ceramic material for at least the movable valve member permits the combustion temperature in the engine cylinder to be raised. The modest coefficient of thermal expansion of the ceramic material, particularly silicon carbide (SiC) or silicon nitride ($Si_3N_4$), also permits very closely toleranced mating dimensions to be achieved, thus ensuring excellent sealing integrity of the valve even at elevated temperatures.

Another consideration is that the invention eliminates truncated cone sealing surfaces, so that the fluid is allowed more readily to flow from the valve and into the combustion space in more favorable and freely chosen directions. Additionally, the movable valve member can readily be designed for minimum turbulence of the entry or exit flow of the fluid by, e.g., giving it a flow-promoting bulge projecting into the combustion space. However, the resultant greater bulge will not overload the movable valve member thermally by aggravated heat absorption, since it is made of a ceramic material.

Further objects and advantages of the present invention will become apparent from the following description.

According to a feature of the invention, the stationary cylindrical surface is formed with a flared lead-in shape to make sure the valve member, considering the normally rather distant bearing support for the valve stem, will invariably and properly enter the mating stationary cylindrical sealing surface. The invention also provides for minimized turbulence at the valve by means of a bulbous valve member bulging into the combustion space. With the valve open, the fluid will flow around the movable valve member, or through the movable valve member, if it is hollow and ported. Where hollow movable valve members are used, the directions of the entry and exit flows can be varied by proper porting arrangements. The hollow movable valve member of the intake or exhaust valve can optionally also exhibit at its front end, on the combustion space side, a single, possibly large opening, and on the other side of the wall, a circumferentially arranged closing port or ports. It may be an advantage to circumferentially equally space the ports all around the valve cylinder. When the valve is an inlet valve, a port can be arranged to set up rotational motion or whirl of the fluid in the combustion space. This whirl carries the relatively light-weight combustion gases inside, and the relatively cool air not involved in the combustion process outside. This makes for a thermally better sealed engine. Combustion space sealing is improved by use of sealing grooves in one of the sealing surfaces. Making the movable valve member hollow reduces its weight. A valve ring or tube may define the stationary valve member having the stationary cylindrical sealing surface, and is preferably made of a ceramic material. It is firmly located in the cylinder head. The movable valve member of a closed intake or exhaust valve of an internal-combustion engine can be displaced or controlled such that during combustion, the size of the combustion space is varied to affect the level or profile of combustion pressure.

The movable valve member, or the movable valve member plus the mating part, is made of silicon carbide (SiC) or silicon nitride ($Si_3N_4$) or optionally of oxide ceramic materials, such as aluminum oxide ($Al_2O_3$) or magnesium oxide (MgO).

The outer diameter of the valve stem may be smaller than the diameter of the cylindrical sealing surfaces.

The valves may be designed such that their flow area lies within the combustion space or interior space of the combustion cylinder of the internal combustion engine. However, these valves can also be designed such that their flow area lies outside the combustion space or the interior area.

The valve of the present invention can be an intake valve or alternatively an exhaust valve especially of an internal-combustion engine. The present invention is intended for general application to internal-combustion engines having linearly reciprocating pistons, especially Diesel and Otto engines.

The valve of the present invention can be provided, e.g., on or near a container, a pipe, or on some other thermal engine, as perhaps as a bypass valve on a turbocharger.

The accompanying drawings illustrate embodiments of valves in accordance with the present invention in simplified longitudinal cross-sectional views containing the cylinder axis of the cylindrical sealing surfaces. Each of these valves can be an intake or alternatively an exhaust valve.

In all the figures, the centerline 10 of the cylindrical sealing surfaces extends in the direction of reciprocating movement (see the double-headed arrow 11 in FIG. 1) of the valve member. The valve member forms, together with a valve stem 12 (shown with a portion broken away), an integral ceramic part, and this unit represents a body of revolution.

Figure 1:
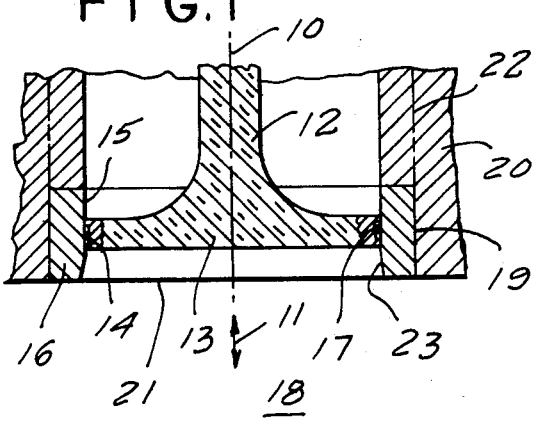
FIG. 1 illustrates a fully closed mushroom valve.

With reference now to FIG. 1, the ceramic valve member includes a valve head 13 having an outer sealing surface 14. The latter engages the cylindrical surface 15 provided by a valve ring 16. The valve head 13 has sealing slots 17 succeeding one another in the direction of the cylinder centerline 10 of the sealing surface 14 of the valve head. The valve ring 16 is made, at least in the case of exhaust valves, of a ceramic material. The valve ring fits within a recess 19 in a cylinder head 20, the recess beginning at the combustion space 18. The cylinder head may also be made of a ceramic material, and defines an opening 21 on the combustion space side of the valve.

In lieu of the valve ring 16, use can be made of a valve tube 22 which is inserted into the cylinder head 20 and also begins at the combustion space 18. The valve ring 16 or the valve tube 22 presents a lead-in surface 23, merging with the sealing surface 15 of the ring 16 or tube 22, which moderately flares conically outwardly as far as the combustion space 18, and which terminates at the combustion space 18 with opening 21.

Figure 2:
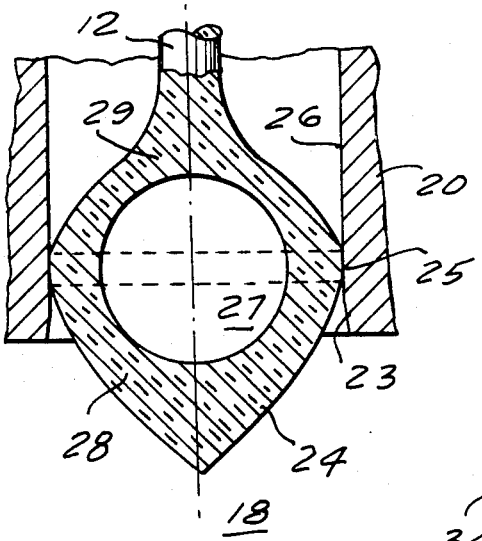
FIG. 2 illustrates a fully closed valve having a bulbous obturating body.

The ceramic valve member 24 of FIG. 2 is a bulb-shaped body having an annular, cylindrical sealing surface 25 in the area of its maximum diameter, the sealing surface being relatively short when compared with its maximum diameter and with the length of the valve member. The stationary cylindrical sealing surface 26 is formed by the cylinder head 20, and has a lead-in surface 23. To economize weight the valve member 24 incorporates an internal, spherical cavity 27. The valve member 24 is given, by its bulbous shape, a flow-promoting bulge 28 projecting into the combustion space 18. The bulge 28 is given a special flow-promoting effect by its centrally pointed configuration extending into the combustion space 18. Again promoting favorable flow is the oppositely arranged bulge 29 and its tapered transition to the integral valve stem 12. The valve member 24 can be viewed as a tear-shaped body.

The valve member 13 (FIG. 1) or 24 (FIG. 2) is displaced into the combustion space 18 to open the valve.

Figure 3:
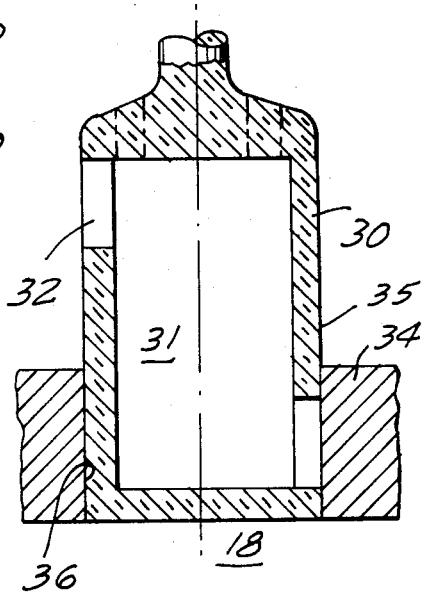
FIGS. 3 and 4 illustrate a valve having a tubular cylindrical member, the valve being completely closed in FIG. 3 and completely open in FIG. 4.
Figure 4:
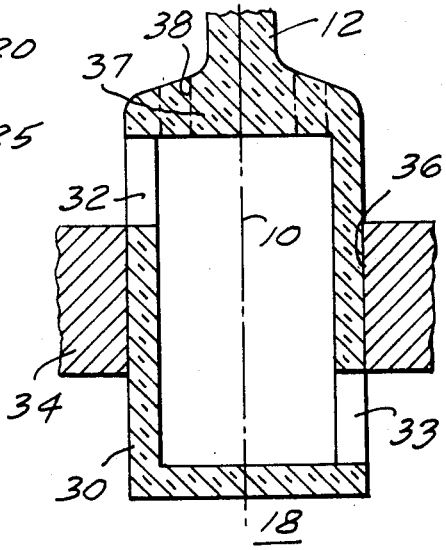

The tubular ceramic cylinder 30 of FIGS. 3 and 4 has a coaxially arranged, cylindrical interior chamber 31, permitting the flow of the valve fluid, and two circumferentially arranged wall cut-outs or ports 32 and 33 for the intake and exhaust, or for the exhaust and the intake, of the fluid involved. The cylinder 30 is guided in the opening of the wall 34 such that leakage is prevented. The surface of the opening forms a stationary cylindrical sealing surface 36 for cooperation with the sealing surface 35 on the circumference of the cylinder 30.

The ports 32 and 33 are arranged diametrically opposite each other, although they may also be angularly spaced apart by smaller angles or not at all. The ports 32 and 33, whether angularly spaced apart or not, are axially spaced apart such that in the fully open position of the valve (FIG. 4) they are both completely exposed and axially clear of the wall 34; the port 32 on the one side of the wall 34 and the port 33 on the other side of the wall 34. In the fully closed position (FIG. 3) of the valve the port 33 is fully inserted in the opening 36. The fluid enters and exits at about right angles to the centerline 10 of the cylinder. For intake valves, swirling flow can be set up in the combustion space 18 by means of a port 33 provided for the exit of fluid in the circumferential wall of the cylinder 30. In lieu of, or in addition to, a port 32, axially parallel ports 38 can be provided in the front wall 37 of the cylinder 30 near the valve stem 12.

The invention has been shown and described in preferred form only, and by way of example, and many variations may be made in the invention which will still be comprised within its spirit. It is understood, therefore, that the invention is not limited to any specific form or embodiment, except insofar as such limitations are included in the appended claims.

What is claimed is:

1. A valve for an internal combustion engine having a combustion chamber, comprising:

a stationary valve member having a radially inwardly facing cylindrical sealing surface, and a valve member movable within the stationary valve member and having a radially outwardly facing annular cylindrical sealing surface, the sealing surface of the movable valve member engaging the sealing surface of the stationary valve member while the two sealing surfaces slide with respect to each other in an axial direction of the sealing surfaces, at least the movable valve member being made of ceramic material; wherein the movable valve member has an inverted tear drop shape formed with said annular cylindrical sealing surface which tapers to a point towards the combustion chamber.

2. A valve as defined in claim 1, wherein the stationary cylindrical sealing surface terminates in an outwardly flared lead-in surface.

3. A valve as in claim 1, wherein one of the sealing surfaces is formed with annular labyrinth grooves, the grooves being arranged along an axis of the cylindrical sealing surfaces.

4. A valve as in claim 1, wherein the movable valve member is hollow.

5. A valve as in claim 1, wherein the stationary cylindrical sealing surface is formed by a tube.

6. A valve as in claim 1, wherein the stationary valve member communicates directly with the combustion space, and the movable valve member can be moved within the stationary valve member while the valve remains closed so as to vary the size of the combustion space and hence vary combustion pressure.

* * * * *